US005266435A

United States Patent [19]

Almog

[11] Patent Number: 5,266,435

[45] Date of Patent: Nov. 30, 1993

[54] LIQUID TONERS CONTAINING CHARGE DIRECTORS AND COMPONENTS FOR STABILIZING THEIR ELECTRICAL PROPERTIES

[75] Inventor: Yaacov Almog, Rehovot, Israel

[73] Assignee: Spectrum Sciences B.V., Wassenaar, Netherlands

[21] Appl. No.: 802,219

[22] Filed: Dec. 4, 1991

[51] Int. Cl.[5] ..... G03G 9/135

[52] U.S. Cl. ..... 430/115; 430/104; 106/316; 252/1

[58] Field of Search ..... 430/104, 115; 252/1; 106/316

[56] References Cited

U.S. PATENT DOCUMENTS 3,290,251 12/1966 Nelson ..... 430/115
3,681,243 8/1972 Okuno et al. ..... 430/115
4,879,197 11/1989 Kohmura et al. ..... 430/119

FOREIGN PATENT DOCUMENTS 12838 1/1977 Japan ..... 430/115
77448 5/1984 Japan ..... 430/115

*Primary Examiner*—Roland Martin
*Attorney, Agent, or Firm*—Sandler Greenblum & Bernstein

[57] ABSTRACT

The invention relates to a homogeneous liquid composition which comprises: (1) liquid hydrocarbon compatible with liquid toners for electrostatic imaging, (2) at least one charge director, and (3) at least one stabilizing component in an amount effective to stabilize the electrical properties of said at least one charge director, said component being selected from piperidinemethanol and polyoxyalkylene ethers of formula $R(O—A)_nOH$, wherein R is alkyl or alkenyl containing 10–20 carbon atoms, A is $C_{2-3}$-alkylene and n is 2–24; and to liquid toners characterized by the presence of at least one charge director and at least one stabilizing component therefor as defined in (3), above.

27 Claims, 6 Drawing Sheets

LIQUID TONERS CONTAINING CHARGE DIRECTORS AND COMPONENTS FOR STABILIZING THEIR ELECTRICAL PROPERTIES

FIELD AND BACKGROUND OF THE INVENTION

This invention relates to the field of electrostatic imaging and, more particularly, to homogeneous compositions and liquid toners containing components for improving the stabilization of the electrical properties due to the charge directors contained therein.

In the art of electrostatic photocopying or photoprinting, a latent electrostatic image is generally produced by first providing a photoconductive imaging surface with a uniform electrostatic charge, e.g. by exposing the imaging surface to a charge corona. The uniform electrostatic charge is then selectively discharged by exposing it to a modulated beam of light corresponding, e.g., to an optical image of an original to be copied, thereby forming an electrostatic charge pattern on the photoconductive imaging surface, i.e. a latent electrostatic image having a background portion at one potential and a "print" portion at another potential. The latent electrostatic image can then be developed by applying to it charged pigmented toner particles, which adhere to the "print" portions of the photoconductive surface to form a toner image which is subsequently transferred by various techniques to a copy sheet (e.g. paper).

It will be understood that other methods may be employed to form an electrostatic image, such as, for example, providing a carrier with a dielectric surface and transferring a preformed electrostatic charge to the surface. The charge may be formed from an array of styluses. This invention will be described in respect of office copiers, though it is to be understood that it is applicable to other uses involving electrostatographics including electrostatographic printing.

In liquid-developed electrostatic imaging, the toner particles are generally dispersed in an insulating non-polar liquid carrier, generally an aliphatic hydrocarbon fraction, which generally has a high-volume resistivity above $10^9$ ohm cm, a dielectric constant below 3.0 and a low vapor pressure (less then 10 torr. at 25° C.). The liquid developer system further comprises so-called charge directors, i.e. compounds capable of imparting to the toner particles an electrical charge of the desired polarity and uniform magnitude so that the particles may be electrophoretically deposited on the photoconductive surface to form a toner image.

In the course of the process, liquid developer is applied to the photoconductive imaging surface. Under the influence of the electrical potential present in the latent image and a developing electrode which is usually present, the charged toner particles in the liquid developer film migrate to the "print" portions of the latent electrostatic image, thereby forming the developed toner image.

Charge director molecules play an important role in the above-described developing process in view of their function of controlling the polarity and magnitude of the charge on the toner particles. The choice of a particular charge director for use in a specific liquid developer system, will depend on a comparatively large number of physical characteristics of the charge director compound, inter alia its solubility in the carrier liquid, its chargeability, its high electric field tolerance, its release properties, its time stability, the particle mobility, etc., as well as on characteristics of the developer. All these characteristics are crucial to achieve high quality imaging, particularly when a large number of impressions are to be produced.

A wide range of charge director compounds for use in liquid-developed electrostatic imaging are known from the prior art. Examples of charge director compounds are ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc.

Notwithstanding the undoubted utility of charge directors, however, the charging caused thereby is generally unstable. In particular, lecithin, basic barium petronate (BBP) and calcium petronate (CP), which are used as negative charge directors, are unstable under high voltage conditions. Thus, when a solution of charge director (or a dispersion of toner particles in carrier liquid and containing charge director) is subjected to a high electric field, e.g. during the development process, the charge transport characteristics and conductivity suffer from transient suppression, and it may take several minutes for these characteristics to recover. This leads to unstable printing performance when long print runs are undertaken. Further, such solutions or dispersions containing particularly BBP, CP and to a lesser extent lecithin, tend to lose conductivity in the course of time (after dilution with Isopar or other carrier liquids), so that, e.g., solutions or dispersions containing BBP or CP, when diluted with Isopar, will change their conductivity by about one order of magnitude in a day and a half.

In an attempt to improve the quality of the image formed, particularly when using liquid toners containing charge directors, it has been suggested to use adjuvants in the toner compositions, such as polyhydroxy compounds, aminoalcohols, polybutylene succinimide, an aromatic hydrocarbon, a metallic soap or a salt of a Group Ia, IIa, or IIIa metal.

In U.S. Pat. No. 3,681,243 (Okuno), the problem of stained prints in electrophotography with liquid toners, said to be due to lack of smoothness of the relevant surfaces and lack of uniformity of electrical charge, is stated to be solved by use of an additive, which may be a $C_{4-16}$ alcohol or isopropyl alcohol. According to Okuno's disclosure, the resin in the toner is a "polar-controlling resin", e.g. "Nikanol HP-100", the principal component of which is said to be phenol modified xylene resin. However, in this U.S. Patent, there is no explicit reference to the presence of a charge director.

SUMMARY OF THE INVENTION

It is an object of the present invention to provide improved liquid toner compositions containing charge directors and components which stabilize the electrical properties of the charge directors. Other objects of the invention will appear from the description which follows.

The present invention accordingly provides a homogeneous liquid composition which comprises: (1) liquid hydrocarbon compatible with liquid toners for electrostatic imaging; (2) at least one charge director; and (3) at least one stabilizing component in an amount effective to stabilize the electrical properties of the at least one charge director, the stabilizing component being selected from piperidinemethanol and polyoxyalkylene ethers of formula $R(O—A)_nOH$, wherein R is alkyl or alkenyl containing 10–20 carbon atoms, A is $C_{2-3}$-alkylene and n is 2–24.

The present invention moreover provides a liquid toner for electrostatic imaging, which comprises non-polar carrier liquid, colorant particles, at least one charge director and at least one stabilizing component in an amount effective to stabilize the electrical properties of the at least one charge director, the stabilizing component being selected from piperidinemethanol and polyoxyalkylene ethers of formula $R(O—A)_nOH$, wherein R is alkyl or alkenyl containing 10–20 carbon atoms, A is $C_{2-3}$-alkylene and n is 2–24.

Preferred liquid toner compositions according to the invention comprise thermoplastic resin particles dispersed in an insulating non polar carrier liquid having a volume resistivity above $10^9$ ohm-cm and a dielectric constant below 3.0; colorant particles micro-dispersed in the carrier liquid; at least one charge director; and at least one stabilizing component in an amount effective to stabilize the electrical properties of the at least one charge director, the stabilizing component being selected from piperidinemethanol and polyoxyalkylene ethers of formula $R(O—A)_nOH$, wherein R is alkyl or alkenyl containing 10–20 carbon atoms, A is $C_{2-3}$-alkylene and n is 2–24.

It has been found that such toner compositions exhibit excellent time stability of charge and reduction of conductivity loss under high voltage conditions, as well as excellent recovery of charge after subjection to high voltage conditions. Also, use of such toner compositions results in images of very good copy quality and relatively long stability.

The present invention yet further provides an electrostatic imaging process which comprises the steps of: forming a charged latent electrostatic image on a photoconductive surface; applying to said surface oppositely charged colorant particles from a toner composition which comprises colorant particles, at least one charge director and at least one stabilizing component as defined above, in an amount effective to stabilize the electrical properties of said at least one charge director.

BRIEF DESCRIPTION OF THE DRAWINGS

FIG. 4 in addition compares this effect with certain alcohols not according to the invention.

DETAILED DESCRIPTION OF THE INVENTION

Figure 1:
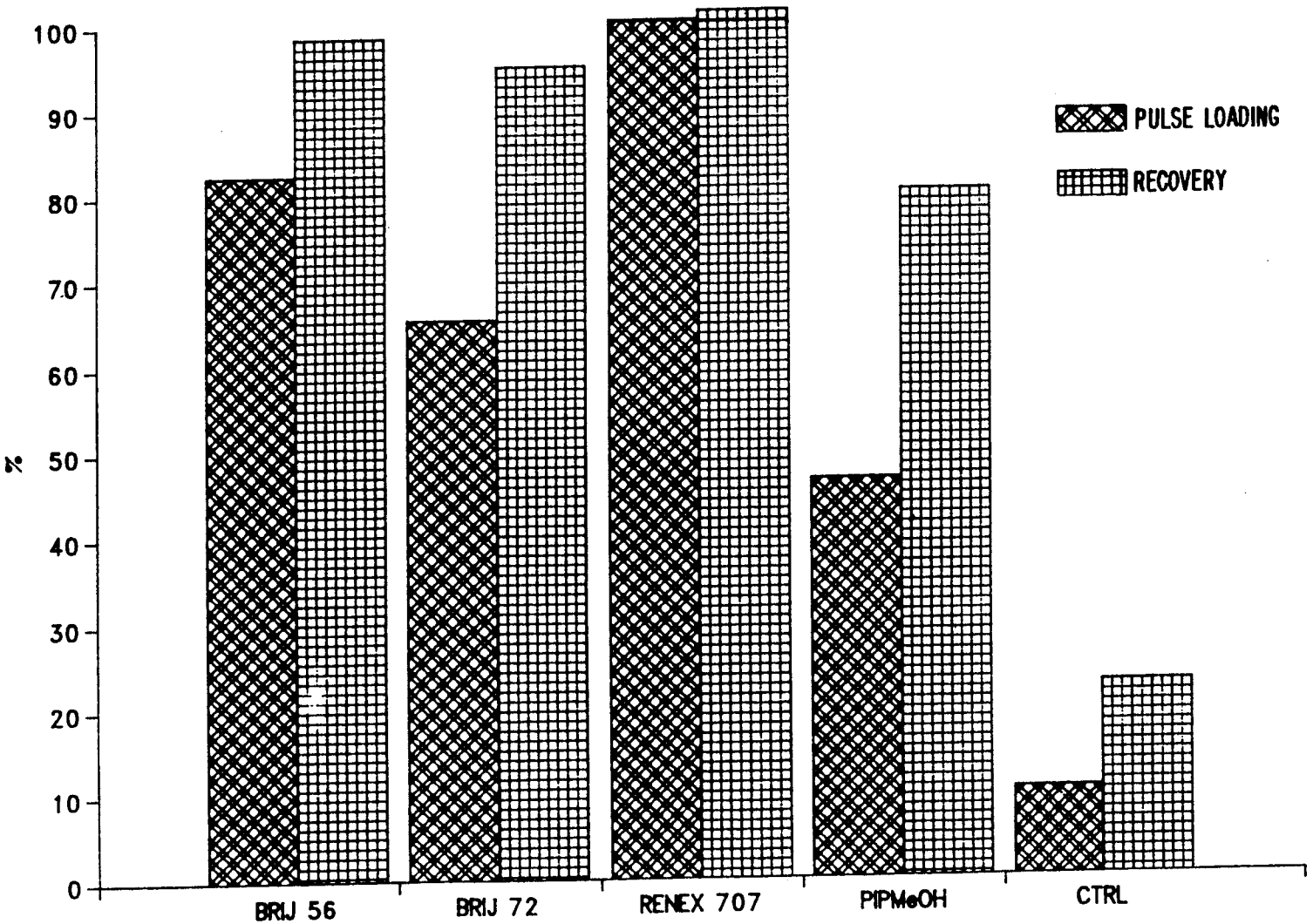
FIGS. 1–4 show the effect of the stabilizing component of the invention on the electrical stability of carrier liquid compositions containing charge directors.

The thermoplastic resins, insulating non-polar carrier liquids, colorant particles and charge directors, which may suitably be used in the toner compositions of the invention are known in the art. Illustratively, the insulating non-polar liquid carrier, which should preferably also serve as the solvent for the charge directors, is most suitably an aliphatic hydrocarbon fraction having suitable electrical and other physical properties. Preferred solvents are the series of branched-chain aliphatic hydrocarbons and mixtures thereof, e.g. the isoparaffinic hydrocarbon fractions having a boiling range above about 155° C., which are commercially available under the name Isopar (a trademark of the Exxon Corporation).

As set forth above, the at least one component for stabilizing the electrical properties of the at least one charge director is selected from piperidinemethanol and polyoxyalkylene ethers of formula $R(O—A)_nOH$, wherein R is alkyl or alkenyl containing 10–20 carbon atoms, A is $C_{2-3}$-alkylene and n is 2–24. Without prejudice to the generality of the invention, it is presently preferred to select the stabilizing component from piperidine-2-methanol and polyoxyalkylene ethers of formula $R'(O—A)_{n'}OH$, wherein R' is alkyl containing 12–18 carbon atoms, A is ethylene and n' is 2–10. The weight ratio of stabilizing component to charge director in the inventive compositions and liquid toners preferably falls within the range of 0.01–2.0:1.

Among commercially available materials which fall within the scope of the stabilizing component according to the invention are piperidine-2-methanol and the following polyoxyalkylene ethers of formula $R(O—A)_nOH$, in which A is ethylene and R and n are as set out in the following Table, together with their trade names (of ICI—Imperial Chemical Industries):

Table

| R | n | Trade Name |
|---|---|---|
| lauryl | 4 | Brij 30 |
| lauryl | 23 | Brij 35 |
| cetyl | 2 | Brij 52 |
| cetyl | 10 | Brij 56 |
| cetyl | 20 | Brij 58 |
| lauryl | 9 | "polidocanol" |
| lauryl | 10 | |
| $C_{13/15}$-alkyl (primary) | 7 | Renex 707 |
| oleyl | 2 | Brij 92 |
| oleyl | 10 | Brij 96 |
| oleyl | 20 | Brij 99 |
| stearyl | 2 | Brij 72 |
| stearyl | 10 | Brij 76 |
| stearyl | 20 | Brij 78 |
| stearyl | 21 | Brij 721 |
| tridecyl | 10 | |

The person skilled in the art will understand that the above Table does not exhaust the stabilizing components of formula $R(O—A)_nOH$ according to the invention which are commercially available, and that the invention is not limited to the use of commercially available such compounds, insofar as it is well-known how such compounds may be prepared, as e.g. by polyoxyalkylation (oxyethylation and/oxypropylation) of the alcohol ROH, where R is as defined above. The utilization of polyoxyalkylene ethers in accordance with the invention includes the use of materials which are mixtures of compounds of formula $R(O—A)_nOH$, in which A is either ethylene or propylene, as well as materials which contain a mixture of ethylene and propylene radicals for A. The person skilled in the art will appreciate that in commercially available mixtures of polyoxyalkylene ethers of formula $R(O—A)_nOH$, n may designate an average number for a particular mixture.

The stabilizing components may be included in the liquid toners by any suitable method, and the methods exemplified herein are to be regarded as illustrative only, and not limitative. In a particular embodiment, the stabilizing component(s) is/are mixed with charge director(s) in carrier liquid. Where the stabilizing component(s) and/or charge director(s) are not soluble in the carrier liquid, it is preferred to solubilize them by heating, e.g. at about 40° C. The solution of stabilizing component(s) and charge director(s) may then be admixed with the diluted toner containing pigment and resin.

The invention will be illustrated by the following non-limiting Example, in which all "parts" are parts by weight.

EXAMPLE (a) Ten parts of Elvax II 5950 (E.I. du Pont) and five parts of Isopar L (Exxon) are mixed at low speed in a jacketed double planetary mixer connected to an oil heating unit set at 130° C. for one hour. 5 parts of Isopar L are added to the mix in the double planetary mixer and the whole is mixed for a further hour at high speed. Ten parts of Isopar L, preheated to 110° C. are added, and the mixing is continued without heating until the temperature of the mixture drops to 40° C.

(b) Ninety grams of the product of part (a) is transferred to a Union Process 01 attritor together with 7.5 g. of Mogul L carbon black (Cabot) and 120 g. Isopar L. The mixture is ground for 24 hours with water cooling ($\approx$20° C.). The resultant toner particles have an average (weight) diameter of about 2.1 $\mu$m.

(c) Four charge directors are used, namely, BBP or CP-25H (Witco), and 50—50 mixtures of lecithin with BBP or CP. 600 g. Isopar L is used to dissolve 60 g. charge director(s) until a homogeneous solution is obtained, to which was added the stabilizing component(s) according to the invention, heating if necessary (e.g. at 40° C.) to obtain a homogeneous solution. The amount of stabilizing component(s) may be, e.g., 0.25-10 wt. % in the Isopar solution, but up to 1 wt. % is usually adequate. It is noted that BBP and CP when added to lecithin improve its humidity tolerance (which is poor when used alone); the stabilizing components do not appear to affect the humidity stability of any of the charge directors including the mixtures.

(d) The toner concentrate from part (b) is diluted to a non-volatile solids content of 1.5%, using Isopar L. Charge director solution including stabilizing component, from part (c), is added in an amount of e.g. 5-100 mg. charge director solids per g. of toner solids. The toners thus produced were tested in a Savin 870 printer. Print quality was equal to that of toner without the additives.

Electrical Stability Under High Voltage Applications

These measurements are made for solutions containing charge directors alone (as control), or with the addition of stabilizing components, prepared according to part (c) of the Example, above, and diluted with the same carrier liquid. A solution of o.1 wt. % charge director (and, when present, stabilizing component in the concentrations described below) is placed in an electrical cell having a one mm. separation between plate electrodes. A first pulse of 1500 volts having a duration of 8 seconds is applied to the electrodes and the total charge transported is measured. This charge represents the "basis" value for comparison. After a 1 second delay a second pulse of 1500 volts having a duration of 64 seconds is applied; this pulse is designed to cause depletion of the charge director by high voltage loading. After a further 1 second delay a third pulse of 1500 volts having a duration of 8 seconds is applied and the total charge transported is measured. This charge represents the diminished charge transport capability of the material after being subjected to a high voltage. After a 1 minute wait an additional pulse of 1500 volts having a duration of 8 seconds is applied and the total charge transported is measured; this charge is a measure of the recovery of the charge director after being subjected to high voltage.

The results of this study are shown in FIGS. 1-4, which show clearly that addition of the stabilizing components in accordance with the invention improved both the pulse loading and recovery characteristics of the charge director. In these figures, PIPMeOH or PIPOH means piperidine-2-methanol, BRI=BRIJ and RE=RENEX (BRIJ 56, BRIJ 72 and RENEX 707 being as identified in the above Table). The charge directors in the figures (concentrations of stabilizing components shown in parentheses) were prepared as follows:

FIG. 1: 5 g lecithin and 5 g CP, with 0.01 g BRIJ 56 or 0.5 g BRIJ 72 or 0.5 g RENEX 707 or 0.5 g PIPMeOH, were dissolved in Isopar L to make 100 g total solution.

Figure 2:
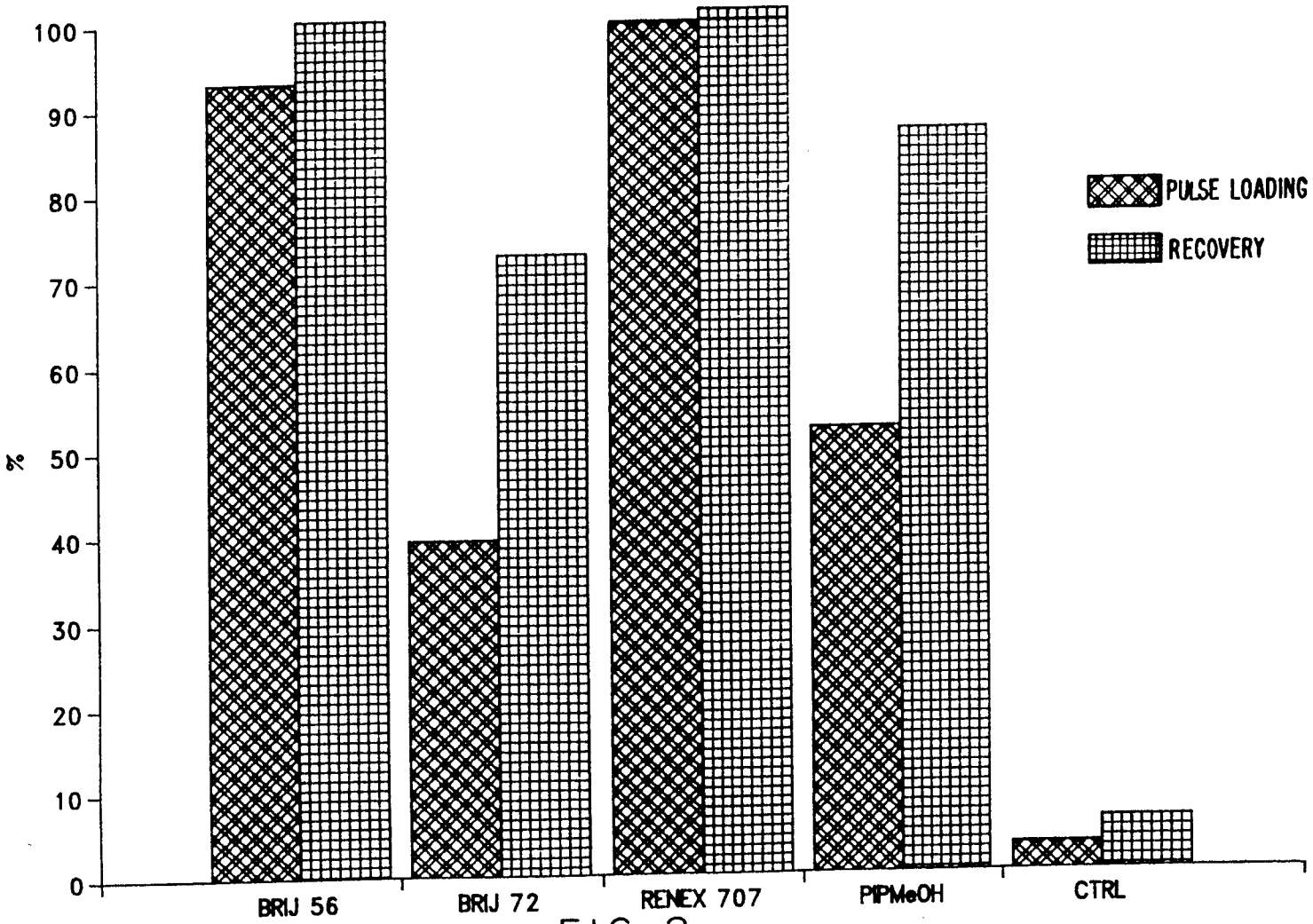

FIG. 2: 10 g CP, with 0.025 g BRIJ 56 or 0.75 g BRIJ 72 or 0.5 g RENEX 707 or 0.75 g PIPMeOH, were dissolved in Isopar L to make 100 g total solution.

Figure 3:
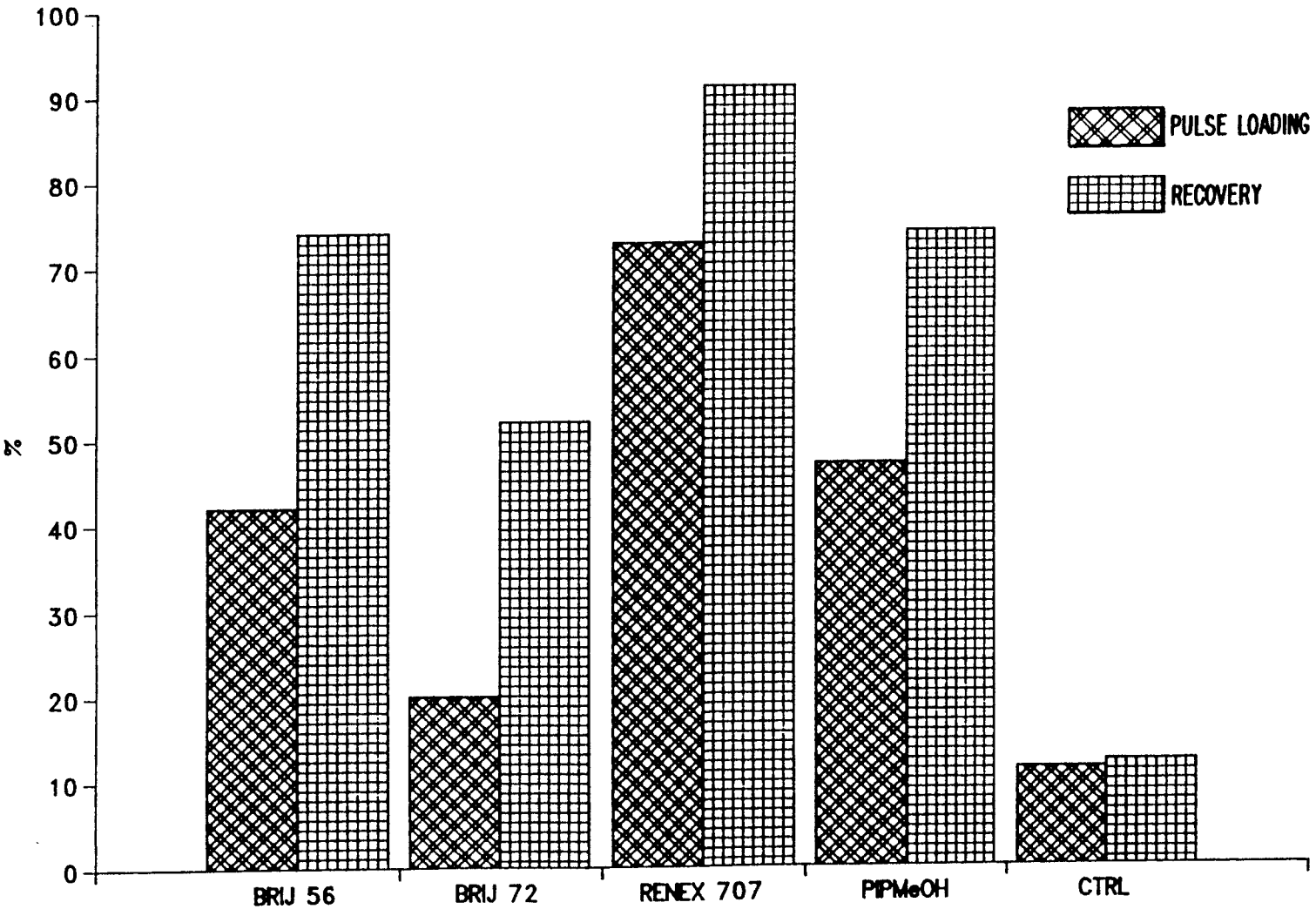

FIG. 3: 10 g BBP, with 0.5 g BRIJ 56 or 0.75 g BRIJ 72 or 0.75 g RENEX 707 or 0.75 g PIPMeOH, were dissolved in Isopar L to make 100 g total solution.

Figure 4:
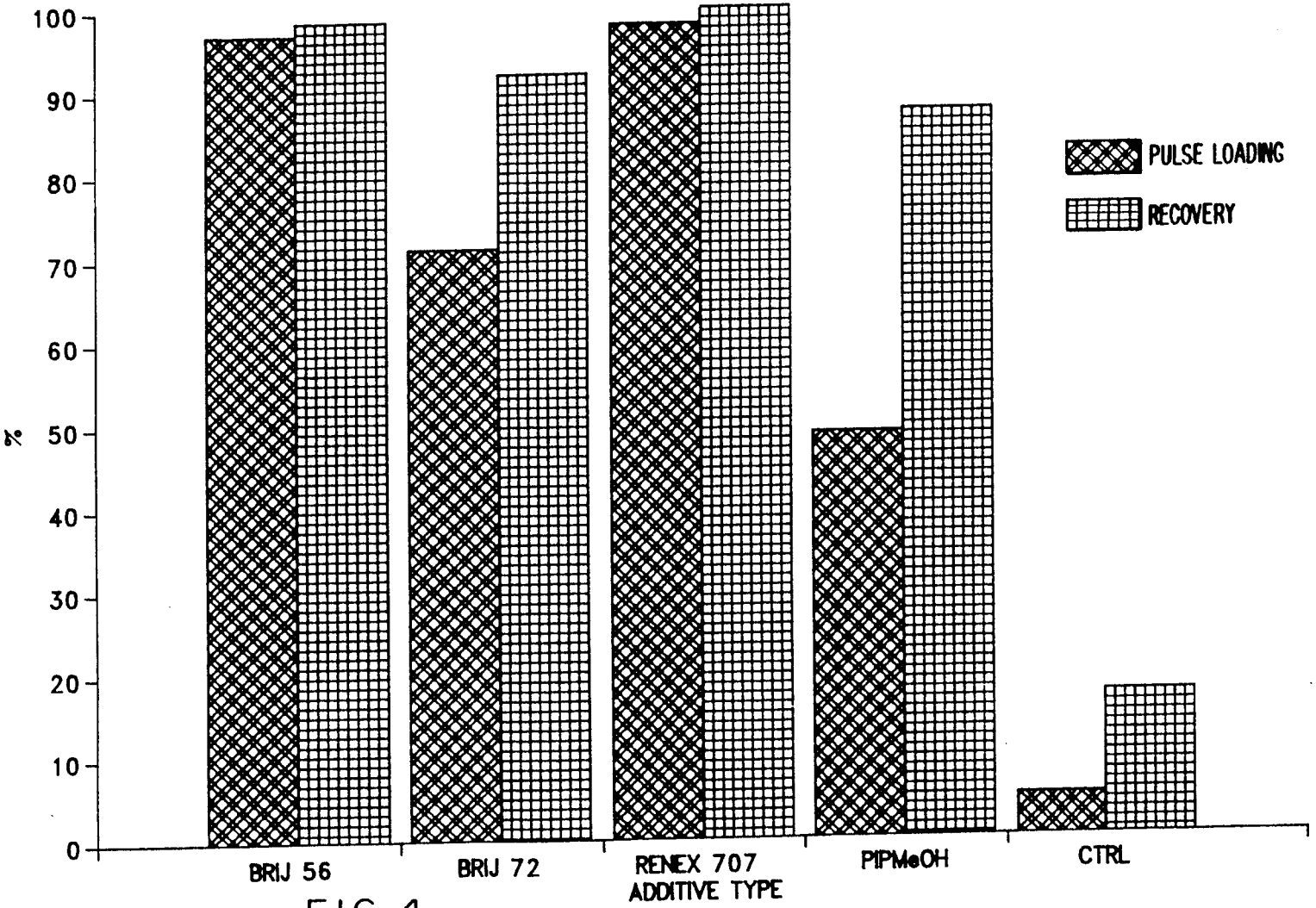

FIG. 4: 5 g lecithin and 5 g BBP, with 1 g BRIJ 56 or 1 g BRIJ 72 or 1 g RENEX 707 or 1 g PIPMeOH, were dissolved in Isopar L to make 100 g total solution.

As is clearly seen from these Figs. the addition of stabilizing components to solutions of charge director material substantially improves the stability of these solutions.

Conductivity Kinetics (Stability of Conductivity with Time)

Figure 5:
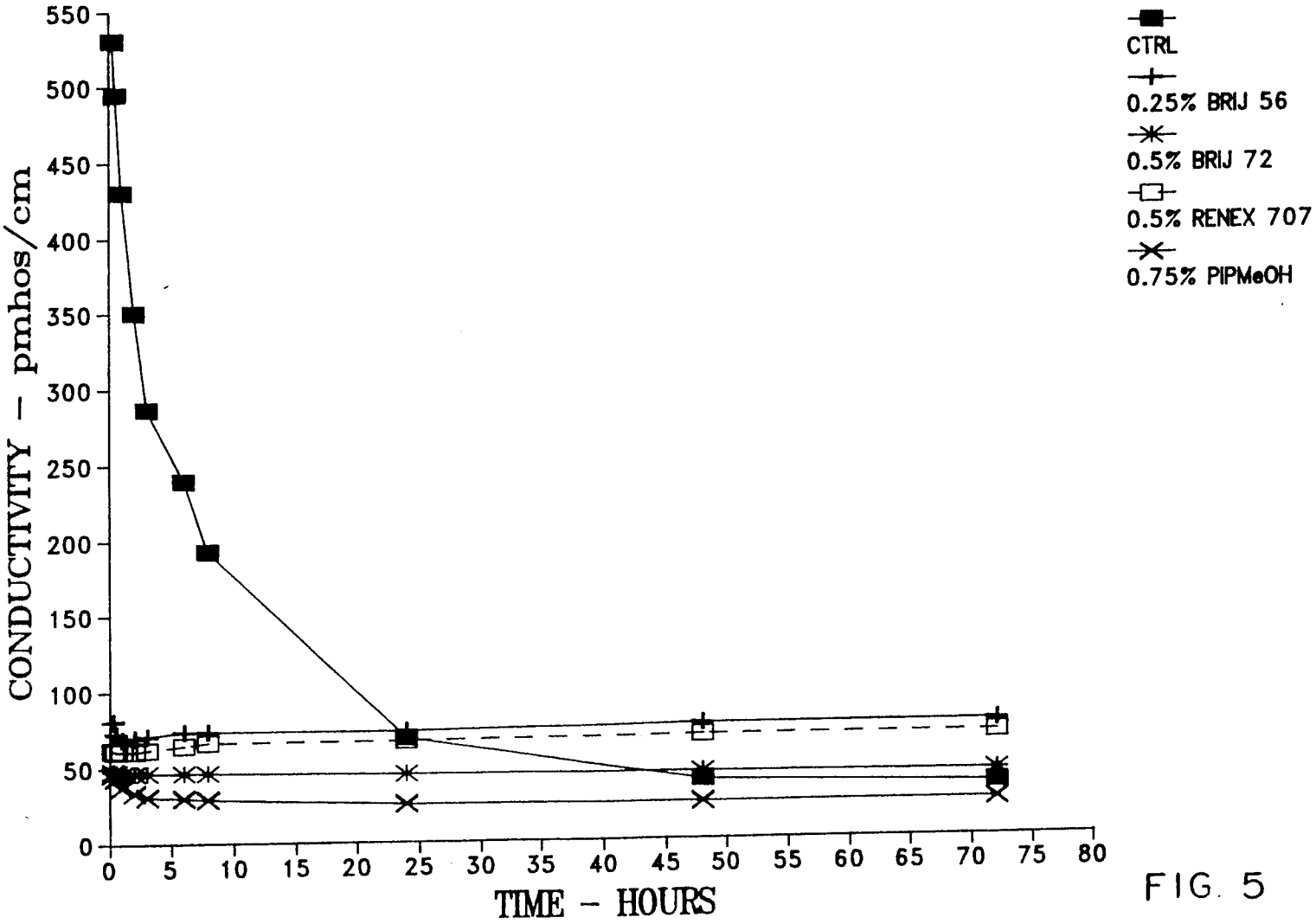
FIGS. 5 and 6 show the effect of the stabilizing component of the invention on the conductivity kinetics of compositions containing charge directors.
Figure 6:
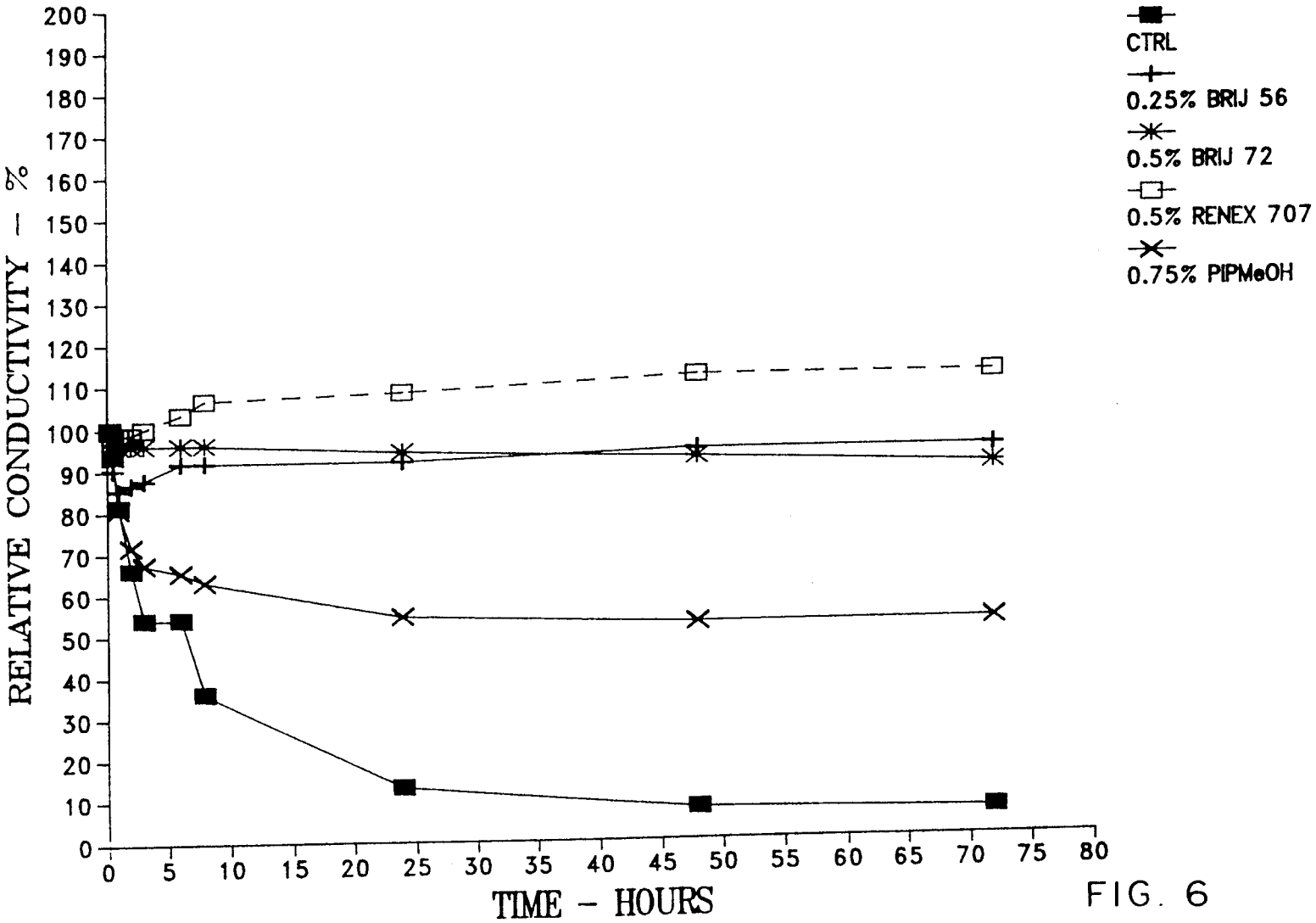

The effect of stabilizers on conductivity degradation, following dilution from a stock solution of 10% BBP in Isopar L to a 0.1% solution in Isopar L, is presented in FIGS. 5 and 6. The control results (i.e. without stabilizers) are represented by the curve made with the solid rectangles. The stabilizers and details of the preparation of the stabilized solutions were as follows: Renex 707: 10 g BBP+0.5 g Renex 707 were dissolved in Isopar L to make 100 g solution (hollow rectangles); BRIJ 56: 10 g BBP+0.25 g BRIJ 56 were dissolved in Isopar L to make 100 g solution (plus signs); PIPMeOH: 10 g BBP+0.75 g PIPMeOH were dissolved in Isopar L to make 100 g solution (crosses); BRIJ 72: 10 g BBP+0.5 g BRIJ 72 were dissolved in Isopar L to make 100 g solution (stars). In FIG. 5, where the effect of the stabilizing components is clearly pronounced in the first 25 hours, by comparison with the control. t should be noted that the desired range of toner conductivity is generally below 100 pmhos/cm. FIG. 6 depicts a plot of relative conductivity against time, where relative conductivity is defined as the % ratio of conductivity based to the initial value of conductivity, for each solution tested.

While the present invention has been particularly described, persons skilled in the art will appreciate that many variations and modification can be made. Therefore, the invention is not to be construed as restricted to the particularly described embodiments, rather the scope, spirit and concept of the invention will be more readily understood by reference to the claims which follow.

I claim:

1. A homogeneous liquid composition which comprises:
(1) liquid hydrocarbon compatible with liquid toners for electrostatic imaging;
(2) at least one negative charging charge director; and
(3) at least one stabilizing component in an amount effective to stabilize the electrical properties of said at least one charge director, said component being polyoxyalkylene ethers of formula $R(O—A)_nOH$, wherein R is alkyl or alkenyl containing 10–20 carbon atoms, A is $C_{2-3}$-alkylene and n is 2–24.

2. A homogeneous composition according to claim 1, wherein said liquid hydrocarbon comprises an insulating non-polar liquid hydrocarbon having a volume resistivity above $10^9$ ohm-cm and a dielectric constant below 3.0

3. A homogeneous composition according to claim 1, wherein the weight ratio of stabilizing component to charge director falls within the range of 0.05–2.0:1.

4. A homogeneous composition according to claim 1, wherein said component is polyoxyalkylene ethers of formula $R'(O—A)_{n'}OH$, where R' is alkyl containing 12–18 carbon atoms, A is ethylene and n' is 2–10.

5. A homogeneous composition according to claim 1, wherein said stabilizing component comprises polyoxyalkylene ethers of formula $R(O—A)_nOH$, designated (i), (ii) and (iii), in which A is ethylene and R and n are as follows, namely:
(i) R is cetyl and n is 10;
(ii) R is stearyl and n is 2;
(iii) R is a primary alkyl having 13–15 carbon atoms and n is 7.

6. A homogeneous composition according to claim 1, wherein said at least one charge director is selected from the group consisting of lecithin, basic barium petronate and calcium petronate.

7. A homogeneous composition according to claim 6, wherein said stabilizing component comprises polyoxyalkylene ethers of formula $R(O—A)_nOH$, designated (i), (ii) and (iii), in which A is ethylene and R and n are as follows, namely:
(i) R is cetyl and n is 10;
(ii) R is stearyl and n is 2;
(iii) R is a primary alkyl having 13–15 carbon atoms and n is 7.

8. A liquid toner for electrostatic imaging, which comprises non-polar carrier liquid, colorant particles, at least one negative charging charge director and at least one stabilizing component in an amount effective to stabilize the electrical properties of said at least one charge director, said component being polyoxyalkylene ethers of formula $R(O—A)_nOH$, where R is alkyl or alkenyl containing 10–20 carbon atoms, A is $C_{2-3}$-alkylene and n is 2–24.

9. A liquid toner according to claim 8, wherein said non-polar carrier liquid comprises insulating liquid hydrocarbon having a volume resistivity above $10^9$ ohm-cm and a dielectric constant below 3.0.

10. A liquid toner according to claim 8, wherein the weight ratio of stabilizing component to charge director falls within the range of 0.05–2.0:1.

11. A liquid toner according to claim 8, wherein said component is polyoxyalkylene ethers of formula $R'(O—A)_{n'}OH$, wherein R' is alkyl containing 12–18 carbon atoms, A is ethylene and n' is 2–10.

12. A liquid toner according to claim 8, wherein said stabilizing component comprises polyoxyalkylene ethers of formula $R(O—A)_nOH$, designated (i), (ii) and (iii), in which A is ethylene and R and n are as follows, namely:
(i) R is cetyl and n is 10;
(ii) R is stearyl and n is 2;
(iii) R is a primary alkyl having 13–15 carbon atoms and n is 7.

13. A liquid toner according to claim 8, wherein said at least one charge director is selected from the group consisting of lecithin, basic barium petronate and calcium petronate.

14. A liquid toner according to claim 13, wherein said stabilizing component comprises the group consisting of polyoxyalkylene ethers of formula $R(O—A)_nOH$, designated (i), (ii) and (iii), in which A is ethylene and R and n are as follows, namely:
(i) R is cetyl and n is 10;
(ii) R is stearyl and n is 2;
(iii) R is a primary alkyl having 13–15 carbon atoms and n is 7.

15. A liquid toner for electrostatic imaging which comprises colored thermoplastic resin particles dispersed in an insulating non polar carrier liquid having a volume resistivity above $10^9$ ohm-cm and a dielectric constant below 3.0; at least one negative charging charge director; and at least one stabilizing component in an amount effective to stabilize the electrical properties of said at least one charge director, said component being polyoxyalkylene ethers of formula $R(O—A)_nOH$, wherein R is alkyl or alkenyl containing 10–20 carbon atoms, A is $C_{2-3}$-alkylene and n is 2–24.

16. A liquid toner according to claim 15, wherein the weight ratio of stabilizing component to charge director falls within the range of 0.05–2.0:1.

17. A liquid toner according to claim 15, wherein said component is the group consisting of polyoxyalkylene ethers of formula $R'(O—A)_{n'}OH$, wherein R' is alkyl containing 12–18 carbon atoms, A is ethylene and n' is 2–10.

18. A liquid toner according to claim 15, wherein said stabilizing component comprises at least one substance of polyoxyalkylene ethers of formula $R(O—A)_nOH$, designated (i), (ii) and (iii), in which A is ethylene and R and n are as follows, namely:
(i) R is cetyl and n is 10;
(ii) R is stearyl and n is 2;
(iii) R is a primary alkyl having 13–15 carbon atoms and n is 7.

19. A liquid toner according to claim 15, wherein said at least one charge director is selected from the group consisting of lecithin, basic barium petronate and calcium petronate.

20. A liquid toner according to claim 1, wherein said stabilizing component comprises at least one substance polyoxyalkylene ethers of formula $R(O—A)_nOH$, designated (i), (ii) and (iii), in which A is ethylene and R and n are as follows, namely:
(i) R is cetyl and n is 10;
(ii) R is stearyl and n is 2;
(iii) R is a primary alkyl having 13–15 carbon atoms and n is 7.

21. An electrostatic imaging process which comprises the steps of:

forming a charged latent electrostatic image on a photoconductive surface;

applying to said surface oppositely charged colorant particles from a toner composition which comprises colorant particles, at least one negative charging charge director and at least at least one stabilizing component in an amount effective to stabilize the electrical properties of said at least one charge director, said component being polyoxyalkylene ethers of formula $R(O—A)_nOH$, wherein R is alkyl or alkenyl containing 10–20 carbon atoms, A is $C_{2-3}$-alkylene and n is 2–24; and transferring the resulting toner image to a substrate.

22. A process according to claim 21, wherein said liquid hydrocarbon comprises an insulating non-polar liquid hydrocarbon having a volume resistivity above $10^9$ ohm-cm and a dielectric constant below 3.0.

23. A process according to claim 21, wherein the weight ratio of stabilizing component to charge director falls within the range of 0.05–2.0:1.

24. A process according to claim 21, wherein said component is polyoxyalkylene ethers of formula $R'(O—A)_{n'}OH$, wherein R' is alkyl containing 12–18 carbon atoms, A is ethylene and n' is 2–10.

25. A process according to claim 21, wherein said stabilizing component comprises polyoxyalkylene ethers of formula $R(O—A)_nOH$, designated (i), (ii) and (iii), in which A is ethylene and R and n are as follows, namely:

(i) R is cetyl and n is 10;

(ii) R is stearyl and n is 2;

(iii) R is a primary alkyl having 13–15 carbon atoms and n is 7.

26. A process according to claim 21, wherein said at least one charge director is selected from the group consisting of lecithin, basic barium petronate and calcium petronate.

27. A process according to claim 26, wherein said stabilizing component comprises polyoxyalkylene ethers of formula $R(O—A)_nOH$, designated (i), (ii) and (iii), in which A is ethylene and R and n are as follows, namely:

(i) R is cetyl and n is 10;

(ii) R is stearyl and n is 2;

(iii) R is a primary alkyl having 13–15 carbon atoms and n is 7.

* * * * *